US009744799B2

(12) United States Patent
Lee

(10) Patent No.: US 9,744,799 B2
(45) Date of Patent: Aug. 29, 2017

(54) PNEUMATICALLY ERASABLE SLATE

(71) Applicant: LIG SCIENCES, INC., Export, PA (US)

(72) Inventor: Sang Beom Lee, Harrison City, PA (US)

(73) Assignee: LIG SCIENCES, INC, Harrison City, PA (US)

( * ) Notice: Subject to any disclaimer, the term of this patent is extended or adjusted under 35 U.S.C. 154(b) by 243 days.

(21) Appl. No.: 14/751,830

(22) Filed: Jun. 26, 2015

(65) Prior Publication Data

US 2016/0009122 A1 Jan. 14, 2016

Related U.S. Application Data

(60) Provisional application No. 62/024,269, filed on Jul. 14, 2014.

(51) Int. Cl.
*B43L 1/12* (2006.01)

(52) U.S. Cl.
CPC ..... *B43L 1/126* (2013.01)

(58) Field of Classification Search
USPC ..... 434/408, 410, 412, 413, 421, 422, 428
See application file for complete search history.

(56) References Cited

U.S. PATENT DOCUMENTS 2,663,095 A 12/1953 Chase
2,789,373 A 4/1957 Frankl
3,135,059 A 6/1964 Barish
3,943,643 A 3/1976 Fisher
4,011,665 A * 3/1977 Port ..... B43L 1/126 434/410
4,051,609 A * 10/1977 Boursaw ..... B43L 1/126 281/30
5,033,746 A 7/1991 Jones
(Continued)

FOREIGN PATENT DOCUMENTS

EP 0730983 A1 9/1996

OTHER PUBLICATIONS

Posting on Amazon.com; https://www.amazon.com/Puff-Tablet-Preschool-Erasable-Writing/dp/B01GENLGI6, Aug. 11, 2014.
(Continued)

*Primary Examiner* — Kurt Fernstrom
(74) *Attorney, Agent, or Firm* — Bartony & Associates, LLC

(57) ABSTRACT

An erasable slate system includes a translucent layer adjacent a colored bottom layer, wherein application of a force to the translucent layer causes temporary adhesion of the translucent layer to the colored bottom layer in an area wherein the force is applied. The erasable slate system further includes an extending channel in fluid connection with the translucent layer and the colored bottom layer. The extending channel extends around at least 25% of the length of a perimeter of the bottom colored layer. The erasable slate system further includes an air pump in fluid connection with the extending channel via which pressurized air can be introduced into the extending channel to cause the translucent layer to be separated from adhesion to the colored bottom layer, thereby erasing markings, and via which air can exit the extending channel of the erasable slate system.

19 Claims, 7 Drawing Sheets

(56) References Cited

U.S. PATENT DOCUMENTS

| | | | | |
|---|---|---|---|---|
| 6,972,151 | B2 * | 12/2005 | Bronson | B43L 1/12 156/386 |
| 2008/0153617 | A1 | 6/2008 | Cameron | |

OTHER PUBLICATIONS

Posting on http://www.ebay.com/itm/Puff-Tablet-New-Erasable-Writing-Magic-Slate-for-drawing-games-education-/261645029250?pt=LH_DefaultDomain_0&hash=item3ceb424f82, published on Aug. 11, 2014.
Posting on YouTube on Aug. 11, 2014 on https://www.youtube.com/watch?v=JuZDN5jrPNI.

* cited by examiner 200
210
150
140
120
130
100
110
152
112
300
10

PNEUMATICALLY ERASABLE SLATE

CROSS-REFERENCE TO RELATED APPLICATIONS

This application claims benefit of U.S. Provisional Patent Application Ser. No. 62/024,269, filed Jul. 14, 2014, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

Reversible or erasable "magic" slates have been used as, for example, toys or educational tablets. Such slates include a plurality of layers of material which may, for example, be formed of plastic and/or paper. Pressure exerted on a top layer or cover of the slate, which is typically formed from a clear plastic film, results in a visible mark created from the temporary adhesion of a lower translucent (typically, cloudy or milky-colored) layer to, for example, a lower, colored (typically, black or dark gray) layer. The translucent layer releasably or nonpermanently adheres to the lower layer when pressure is applied to the top cover. This temporary adhesion results in intimate contact between the two layers allowing the transmittance of the color of the lower layer through the translucent layer and the top cover layer.

A number of slate systems enable erasing by physically lifting the top sheets to separate from the colored adhesive layer, by rubbing the surface which pushes captured air bubbles across and/or shifts upper layer resulting in separation of two layers, or by sliding a bar or other abutment member positioned between the wax-coated bottom black layer and the semi-transparent layer which separates these layers. All of these methods have drawbacks. Physical separating requires a multiple task motion of lifting one end of top film up and then replacing it so that it lies smoothly and squarely on the pad, thus requiring the use of two hands. The rub to erase method can only be used on smaller surfaces, requires multiple rubbings in many cases, and often fails to completely erase markings. Bar-types erasers add complexity, and have been reported to present difficulties in operating and erasing.

A magic slate erase system using an air pump to erase images pneumatically is disclosed in U.S. Pat. No. 3,943,643. The air pump is intended to erases images without requiring manual lifting of the top sheets to separate them from the wax-coated black layer, rubbing the surface, or pulling a bar. However, the air pump of U.S. Pat. No. 3,943,643, which is operatively connected to the cloudy/milky layer and the wax-coated black layer, does not efficiently remove air from the magic slate pad after the first erasing action. In inefficient removal of air makes it difficult for a user to draw subsequent next words/images because some air is left between the cloudy layer and the wax-coated layer. This residual air erases new writings/drawings immediately. Thus, the air left between the cloudy layer and the wax-coated layer requires users to wait for a long time before subsequent drawing action. Air remaining between the cloudy layer and the lower, colored, wax-coated layer makes the slate irreversible. There is a lack of consistency and reproducibility of the slate system in enabling marking while being able to easily and consistently erase such markings.

SUMMARY

In one aspect, an erasable slate system includes a translucent layer adjacent a colored bottom layer, wherein application of a force to the translucent layer causes temporary adhesion of the translucent layer to the colored bottom layer in an area wherein the force is applied. The erasable slate system further includes an extending channel in fluid connection with the translucent layer and the colored bottom layer. The extending channel extends around at least 25% of the length of a perimeter of the bottom colored layer. The erasable slate system further includes an air pump in fluid connection with the extending channel via which pressurized air can be introduced into the extending channel to cause the translucent layer to be separated from adhesion to the colored bottom layer, thereby erasing markings, and via which air can exit the extending channel of the erasable slate system. In a number of embodiments, the extending channel extends around at least 50%, at least 75% or even 100%, of the length of a perimeter of the bottom colored layer.

The air pump may, for example, be placed in fluid connection with the extending channel via a port in fluid connection with the extending channel. In a number of embodiments, the air pump is in fluid connection with the port via a length of tubing. The tubing may, for example, have a length suitable to space the pump from the remainder of the erasable slate system (for example, the components of the slate as described herein), so that the pump need not rest upon or contact the components of the slate. The pump may, for example, include a bellows pump or a bulb pump.

In a number of embodiments, the colored bottom layer includes an adhesive coating so that application of the force to the translucent layer causes temporary adhesion of the translucent layer to the colored bottom layer in an area wherein the force is applied. The adhesive may, for example, include a wax.

In a number of embodiments, the erasable slate system further includes a frame. The extending channel may, for example, be formed in a volume between the frame and the colored bottom layer. The frame may, for example, have a thickness in the range of 0.01 to 10 mm. The air pump may, for example, be connected to the frame or formed within the frame In a number of embodiments, the erasable slate system further includes a base positioned below the colored bottom layer. The extending channel may, for example, be formed in the base. The extending channel may, for example, have a width in the range of 0.01 to 30.0 mm.

The extending channel of the erasable slate system hereof may, for example, be sealed from fluid connection with an environment outside of the erasable slate system other than via the port. The erasable slate system may, for example, further include a transparent (or substantially transparent—for example, having a transparency of 95% of white light) layer above the translucent layer to which the force is applied.

In another aspect, a method of fabricating an erasable slate system, includes positioning a translucent layer adjacent a colored bottom layer, wherein application of a force to the translucent layer causes temporary adhesion of the translucent layer to the colored bottom layer in an area wherein the force is applied, providing an extending channel in fluid connection with the translucent layer and the colored bottom layer, the extending channel extending around at least 25% of the length of a perimeter of the bottom colored layer, and providing an air pump in fluid connection with the extending channel via which pressurized air can be introduced into the extending channel to cause the translucent layer to be separated from adhesion to the colored bottom layer, thereby erasing markings, and via which air can exit the extending channel.

The present devices, systems, and methods, along with the attributes and attendant advantages thereof, will best be appreciated and understood in view of the following detailed description taken in conjunction with the accompanying drawings.

DETAILED DESCRIPTION

Figure 1A:
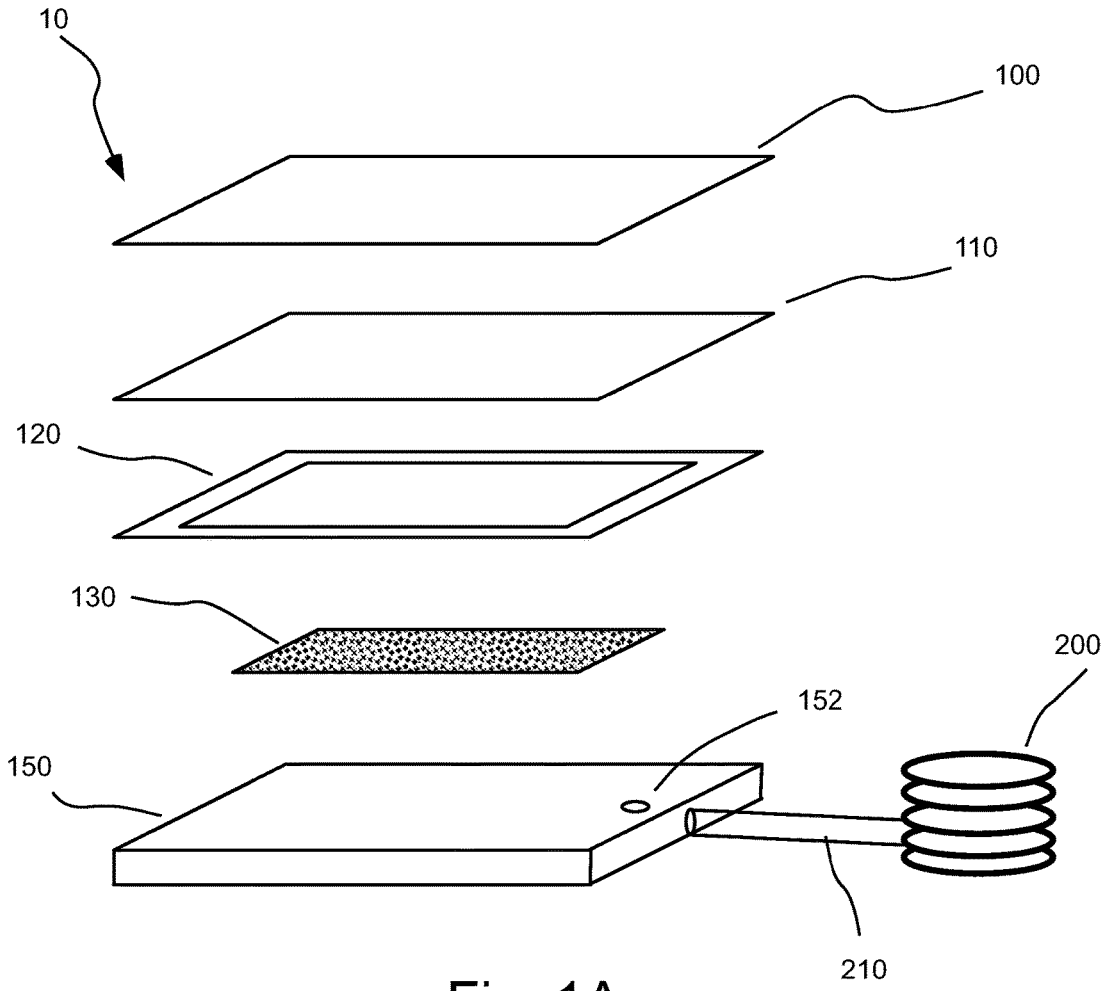
FIG. 1A illustrates a perspective exploded or disassembled view of an embodiment of a slate hereof, including a pneumatic/air pump for use in erasing markings on the slate.
Figure 1B:
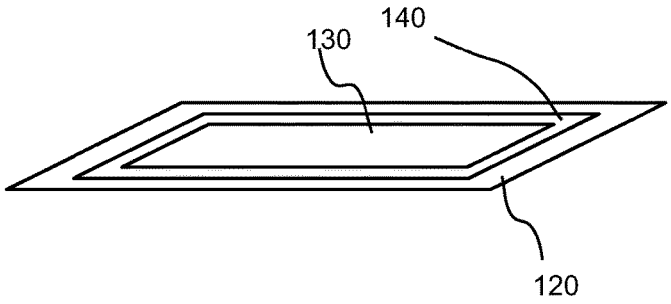
FIG. 1B illustrates the assembly of an adhesive-coated bottom layer and a frame to form an air channel.

It will be readily understood that the components of the embodiments, as generally described and illustrated in the figures herein, may be arranged and designed in a wide variety of different configurations in addition to the described representative embodiments. Thus, the following more detailed description of the representative embodiments, as illustrated in the figures, is not intended to limit the scope of the embodiments, as claimed, but is merely illustrative of representative embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a layer" includes a plurality of such layers and equivalents thereof known to those skilled in the art, and so forth, and reference to "the layer" is a reference to one or more such layers and equivalents thereof known to those skilled in the art, and so forth. Recitation of ranges of values herein are merely intended to serve as a shorthand method of referring individually to each separate value falling within the range. Unless otherwise indicated herein, and each separate value, as well as intermediate ranges, are incorporated into the specification as if individually recited herein. All methods described herein can be performed in any suitable order unless otherwise indicated herein or otherwise clearly contraindicated by the text.

In a number of embodiments, slates, slates tablets, slate systems or slate pads hereof are erasable via a pneumatic or air pump attached to the slate. In a number of such embodiments, slates hereof include a mechanism or system for effectively injecting air into the slate pad and also quickly removing the air from the slate pad. For example, narrow, extending channel may be provided around at least a portion of the perimeter of a lower adhesive-coated (for example, wax-coated) sheet to facilitate air travel therethrough.

The slates hereof have numerous applications including, but not limited to, use by children in a school classroom, use by children and others as a toy, use by persons that are not able to converse because of a tracheotomy or other condition, use by or with people with hearing impairment, use in underwater communications where regular papers get wet etc. A well-sealed, air-pump-driven, erasable slate enables communication between underwater divers in an inexpensive manner and may eliminate the need for complicated electronic communication devices. In addition, in sports wherein locating where a ball hits a club, stick, or bat, etc., an easily erasable slate may be used to improve one's play. For example, an easily erasable pad placed on the surface of a driver or other golf club to locate the spot upon the club face where the golf ball is struck will be useful for improving a golfer's ability to strike a golf ball. In applications as a toy, the slates hereof may, for example, be used as a writing/drawing pad or as an erasable target for toy guns, darts, etc. that shoot relatively soft projectiles.

As, for example, illustrated in FIGS. 1A through 5, an embodiment of a slate 10 hereof includes a plurality of layers. In general, slates hereof include a bottom layer that is colored and a translucent layer adjacent the colored bottom layer. A non-permanent or releasable adhesive material may be disposed between the bottom layer and the translucent layer so that application of force to the translucent layer results in adherence of the translucent layer to the bottom layer. In general, these two layers of material may, for example, be constructed of materials which satisfy the following properties when the layers are in contact: (a) the translucent layer adheres to the bottom layer to a greater degree in areas where pressure is applied than in areas of light contact; (b) the color of the bottom layer is visible through the translucent layer to a greater degree in areas of adherence between the two layers than in areas of no adherence or lesser adherence; (c) the pressure-sensitive adherence described in (c) is releasable without substantially damaging the surface of either layer; and (d) one surface of either the translucent layer or the lower layer, or both, is coated with a pressure sensitive, releasable adhesive. See, for example, U.S. Pat. No. 5,033,746, the disclosure of which is incorporated herein by reference. The pressure sensitive "adhesive" is typically not a material with strong adhesive properties, but rather a material that causes an adjacent layer to stick to it only in the immediate vicinity where the pressure is applied, and with a sticking force that allows for easy separation. See, for example, U.S. Pat. No. 6,972,151, the disclosure of which is incorporated herein by reference.

In the embodiment of FIGS. 1 through 5, a transparent upper layer 100 (for example, formed from a plastic material) is the top layer. A translucent intermediate layer 110 is positioned adjacent upper layer 100 and may, for example, be formed from a cloudy/milky plastic material. A role of upper layer 100 is to protect the translucent intermediate layer 110 from scratches during the drawing actions or other damage. A frame 120 and an adhesive coated (for example, wax-coated) bottom layer 130 (for example, a dark gray or black layer) cooperate to form a narrow channel 140 for air flow as illustrated, for example, in FIGS. 1B and 2. In that regard, the inner dimensions of frame 140 is slightly larger than the dimensions of wax-coated, bottom layer 130. The width of channel 140 can be controlled by changing the dimensions of frame 120 and wax-coated, bottom layer 130. A port, passage or hole 152 formed in a backing sheet of base 150 connects air channel 140 and tubing 210 from air pump 200. In an alternative embodiment a channel similar in operation to channel 140 can be formed in base 150.

Air pump 200 may be formed separately from slate 10 and connected by tubing or hose 210 to be spaced from slate 10. As compared, for example, to a system including an integral air pump sitting on an edge of a slate, the edge (and the slate) can be made smaller, which saves material cost for mass production. Air pump 200 may, for example, be formed as a small bellows or bulb pump as known in the air pump arts. The volume of air transferred to extending channel 140 may, for example, in in the range of 1 mL to 100 mL depending upon the size of channel 140 and slate 10.

After an erasing action to erase images, air between the wax-coated layer and the cloudy layer would quickly move to extending channel 140, and then finally move back to air pump 200, in such a way, that there is no air left between the wax-coated layer and the cloudy layer, and would be ready for the next drawing action.

Figure 2:
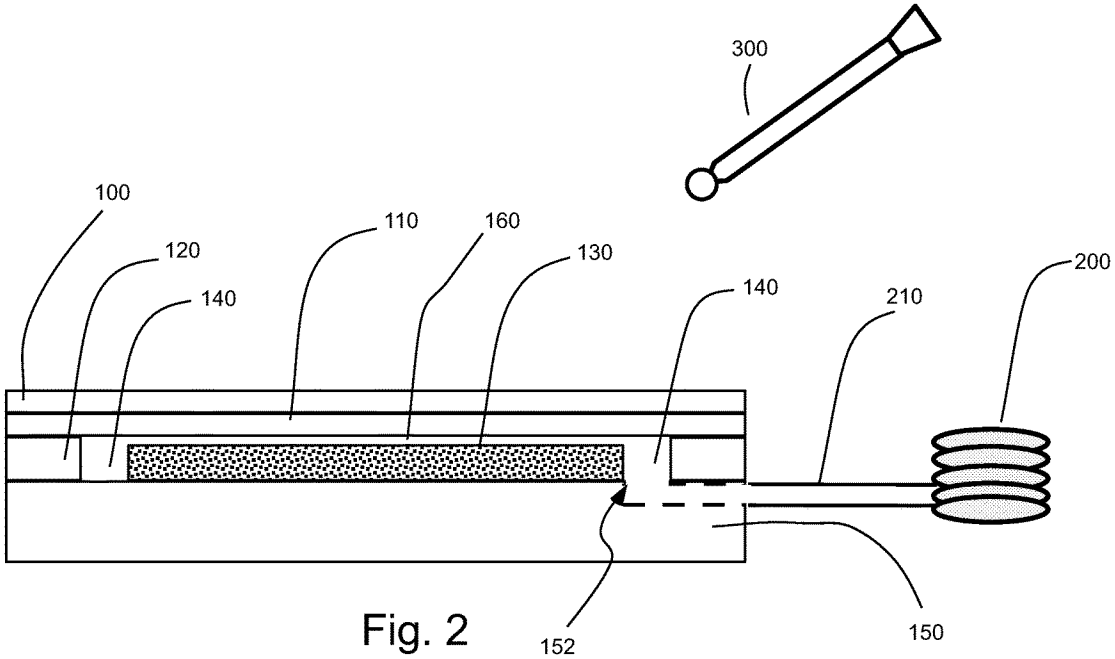
FIG. 2 illustrates a side cutaway view of the slate of FIG. 1A, showing a channel via which air can be quickly supplied and removed.
Figure 3:
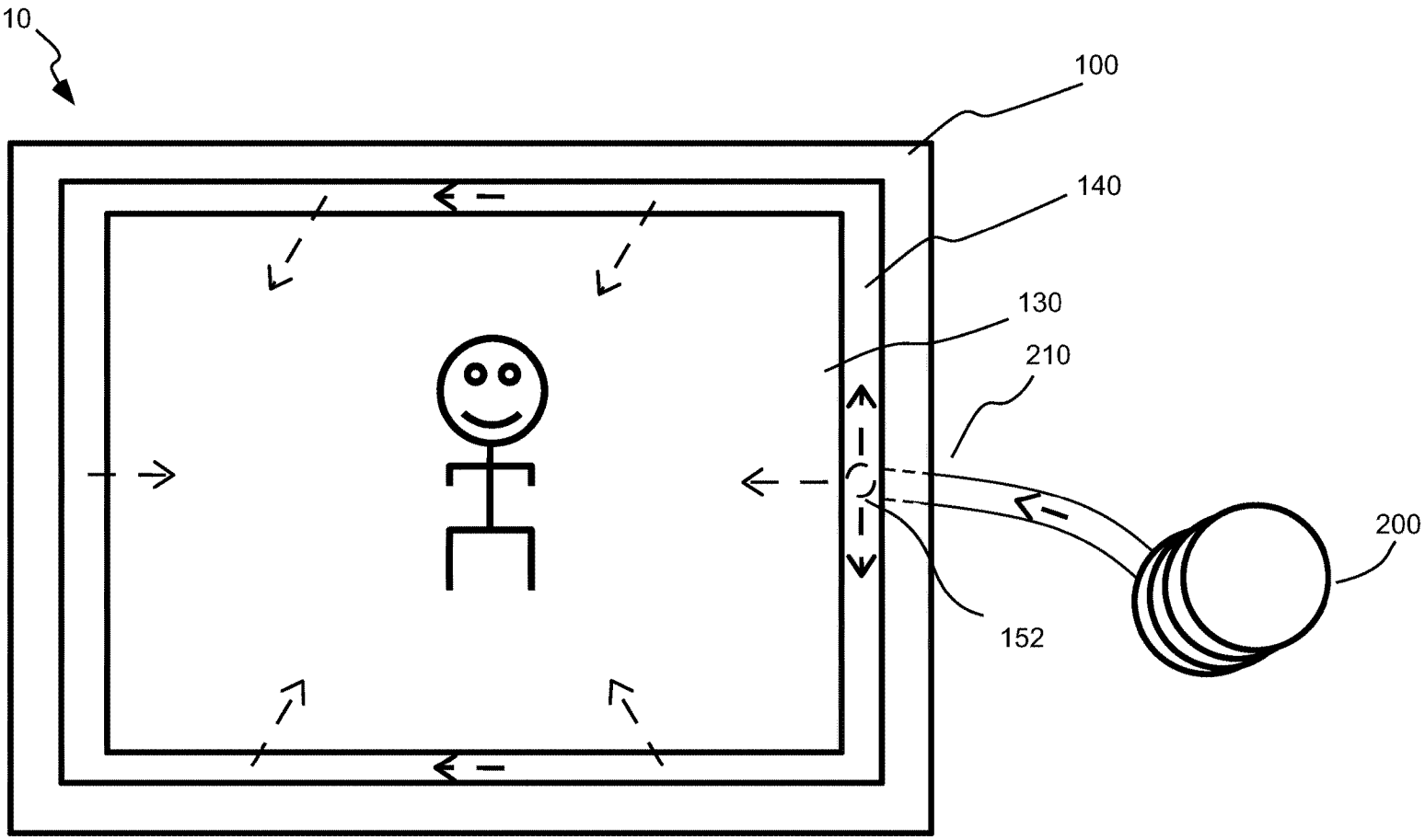
FIG. 3 illustrates a top view of the slate of FIG. 1A.

FIG. 2 illustrates a side, cutaway view of slate 10. A distance or gap 160 between cloudy, translucent layer 110 and wax-coated bottom layer 130 is illustrated to be larger than the actual gap in the figures for ease of understanding. The thickness of frame 120 around wax-coated bottom layer 130 may, for example, be the same or slightly smaller than that of the wax-coated, bottom layer 130 so that the cloudy, translucent layer 110 is not be lifted by frame 120 as a result of the height difference. In other words, if the thickness of frame 120 is greater than the thickness of wax-coated, bottom layer 110, it may be difficult to draw images/make markings because force would be applied to cloudy, translucent layer 110 tending to lift cloudy, translucent layer 110 away from wax-coated, bottom layer 110, thereby immediately erasing images/markings.

Top or upper layer 100 may, for example, be a protective transparent or clear pliable layer that can be from 0.05 mm to 0.50 mm thick. Upper layer 100 may, for example, be formed from a polymer material such as polyethylene, polypropylene, polyvinyl chloride, etc. Intermediately, translucent layer 110 may, for example, be a thin pliable polymeric/plastic layer having a thickness in the range of 0.05 mm to 0.30 mm. Translucent layer 110 is translucent or semi-transparent and may, for example, be slightly colored. In a number of embodiments, translucent layer 110 has a cloudy white color, but other colors that provide good contrast with the color of adhesive-coated/wax-coated bottom layer 130 are also suitable. In a number of embodiments, bottom layer 130 is black. Suitable materials for translucent layer 110 include, but are not limited to, polyacetal, polyvinyl chloride, polyester, high density polyethylene (HDPE), etc. As described above, there is a slight gap 160 and/or normally no adhesion between translucent layer 110 and bottom layer 130 as illustrated in FIG. 2. To make a temporary mark, one can press with any object such as a stylus 300 on upper layer 100 against translucent layer 110. Wax-coated, bottom layer 130 is a different color than translucent layer 110 (typically black), such that translucent layer 110 and bottom layer 130 adhere slightly in response to applied pressure, resulting in transmittance of the color of bottom layer 110 through translucent layer 110, thereby allowing the color of bottom layer 130 be seen from above (through upper layer 100). Bottom layer 130 is slightly adhesive or sticky. In a number of embodiments, bottom layer 130 is formed from paper which is made slightly adhesive or sticky via a wax coating. Adhesive or adhering materials other than wax may be used, however, as known in the adhesive arts.

Figures 4A, 4B:
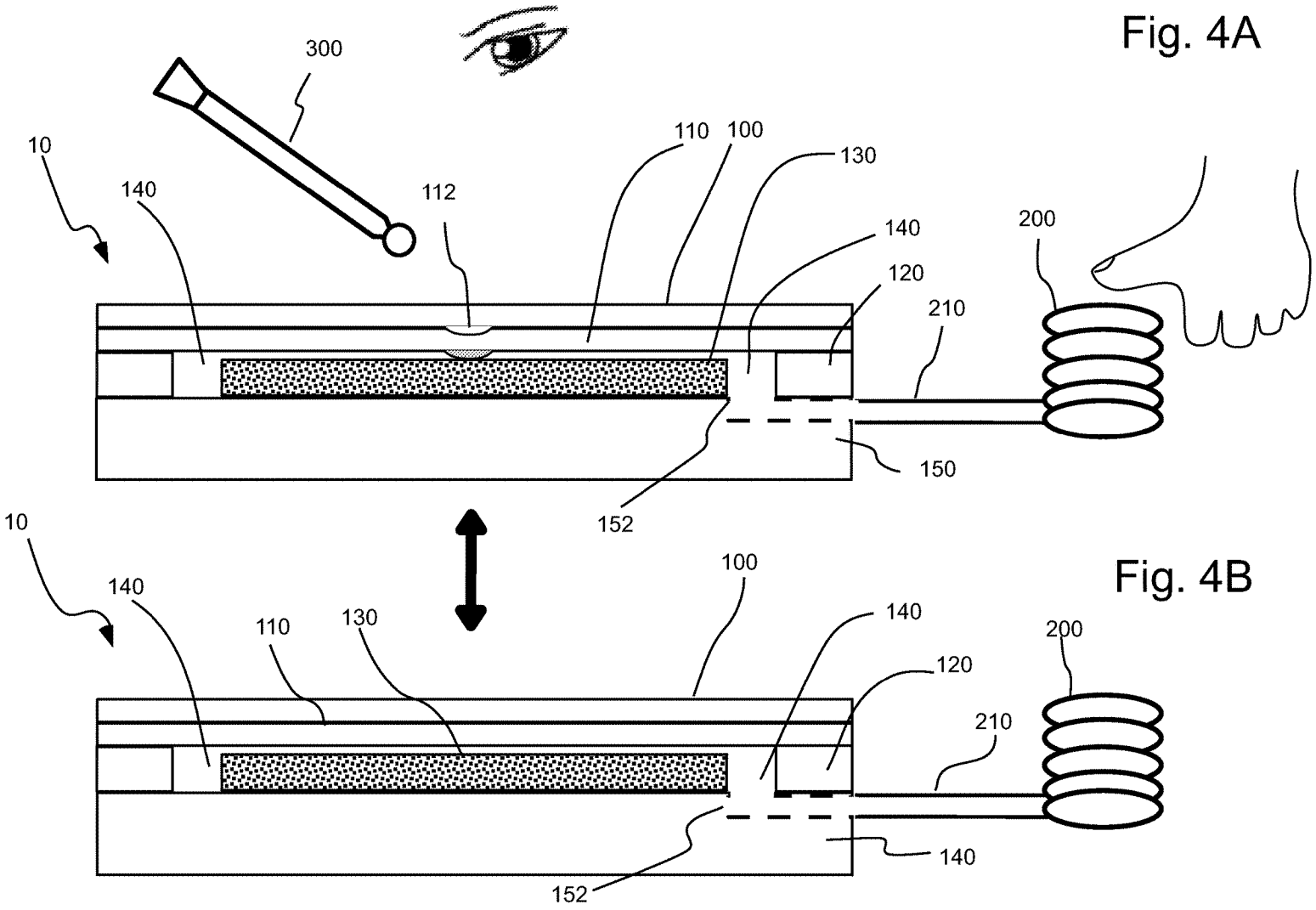
FIG. 4A illustrates a side cutaway view of the slate of FIG. 1A with a mark and a use in preparation to actuate the pneumatic pump to erase the mark.
FIG. 4B illustrates another side cutaway view of the slate of FIG. 1A after then pneumatic pump has been actuated to erase the mark.

Channel 140 provides for both ease of pumping air into and eliminating air from device 10. Drawing and erasing actions are, for example, illustrated in FIGS. 4A and 4B. FIG. 4A illustrates an area 112 wherein translucent layer 110 has been forced into adhering contact with bottom layer 130 cloudy, translucent layer 110 via a stylus 300 so that the color of bottom layer 110 is better transmitted through area 112 that other areas of translucent layer 110 not in adhering contact with bottom layer 130. In FIG. 4A, a user's hand is illustrated in a position to apply force to air pump 200 to force air into channel 140 to lift translucent layer 110 away from contact with bottom layer 130 in area 112 and other areas of contact as illustrated in FIG. 4B, thereby erasing all visible markings. The thickness of the frame 120 may, for example, be in the range of 0.01 mm to 10 mm. The thickness of bottom layer 130 may, for example, be in the range of 0.01 mm to 10 mm. The width of air channel 140 between frame 120 and bottom layer 130 may, for example, be in the range of 0.01 mm to 30 mm. The thickness of backing or base layer 150 may, for example, be in the range of 0.01 mm to 30 mm thick. The diameter of tube 210 that connects slate 10 and air pump 200 may, for example, be in the range of 0.01 mm to 20 mm, and its length may, for example, be in the range of 0 mm to 300 mm.

In the construction of slate 10 the edges or the perimeters of translucent layer 110, frame 120, and base layer 150 are, for example, sealed together with glue or an adhesive to form an airtight seal so that no air escapes to the outside upon actuation of pump 200, but, instead, "inflates" device to create volume or gap 160 (see, for example, FIG. 2) between translucent layer 110 and base 150 In that regard, channel 140 is sealed from the outside environment other than via port 152, which is placed in fluid connection with pump 200. In a number of embodiments, the perimeter of upper layer 100 is also sealed via an air tight seal. In a number of embodiments, layer 130 is sealed, glued or adhered to the base layer 150 so that no air can go between bottom layer 130 and base layer 150.

Figure 5:
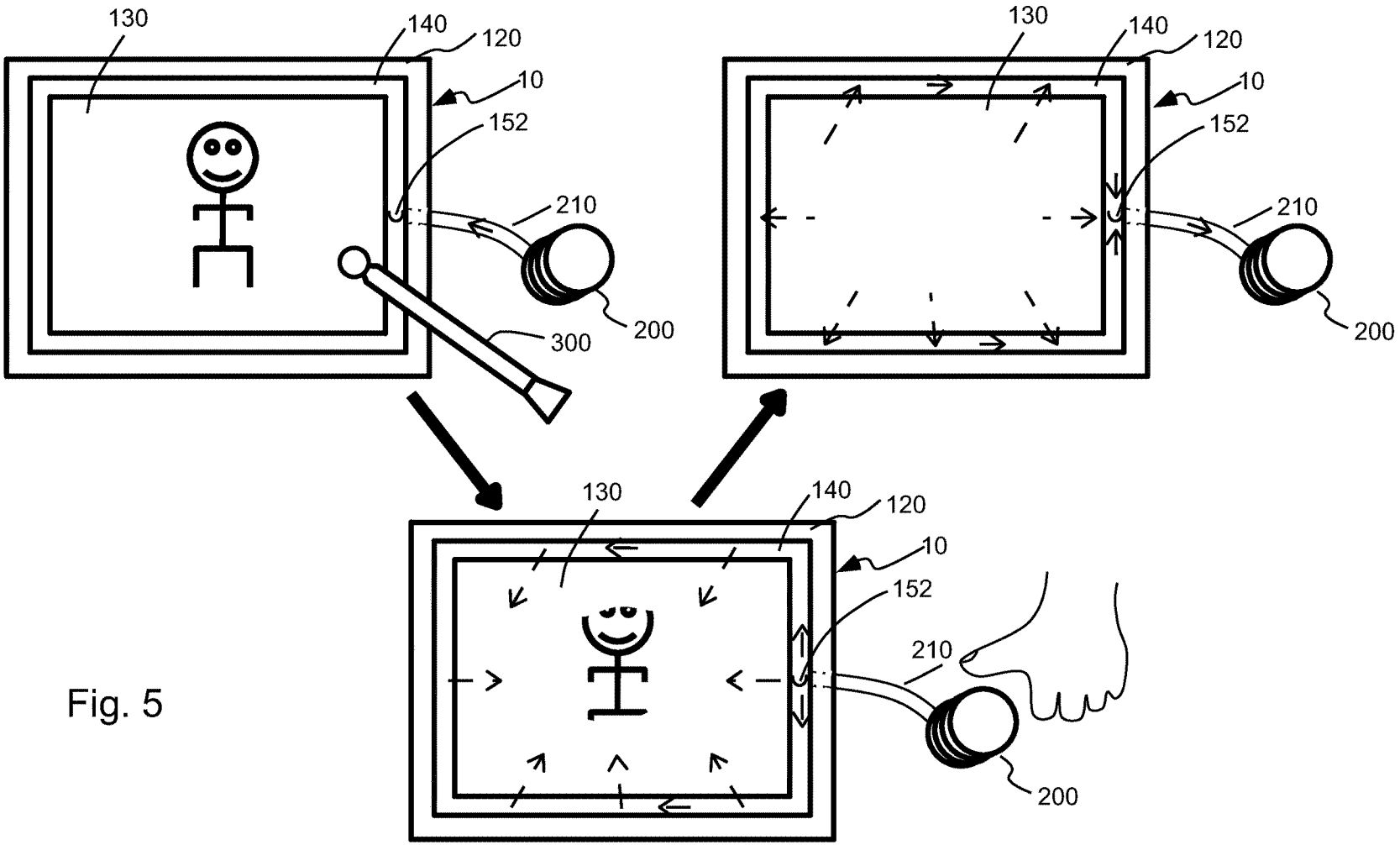
FIG. 5 illustrates a top view of the process of marking the slate and actuating the pneumatic pump to erase markings.

FIG. 5 illustrates three actions in using slate 10 for drawing and erasing images or markings. In the first action illustrated in the upper left portion of FIG. 5, and image is drawn on slate 10. In the bottom center portion of FIG. 5, air pump 200 is actuate to force air into channel 140 as illustrated by arrows, thereby erasing the images or markings. Air is pumped by air pump 200 and travels to slate 10 though tube 210. The air exits port, passage or hole 152 and spreads into narrow 140. The air then moves between bottom layer 130 and translucent layer 110 to erase images/markings. In the upper right corner of FIG. 5, arrows represent the flow of air back into pump 200 via channel 140, port 152 and tube 210. Channel 140 allows air to move from device 10 and into air pump 200 completely and quickly, which makes slate 10 ready for drawing additional images/marking quickly after actuating air pump 200. In the illustrated embodiment, air channel 140 extend around the entire perimeter of bottom layer 130. However, efficient air deliver and removal may be achieved with an extending channel that does not extend around the entire perimeter of bottom layer 130. In a number of embodiments hereof, channel 140 extends around at least 25%, 50%, 75% or 100% of bottom layer 130. Moreover, the shape of the perimeter of bottom layer 130 need not be rectangular or square as illustrated in the representative embodiments hereof, but can be of generally any shape (for example, triangular, oval, circular, curvilinear etc.). A cross-sectional shape perpendicular to the extending length of extending channel 140 may also be of any general shape (for example, triangular, square, rectangular, oval, circular, curvilinear, etc.).

Device 10 requires only one quick, simple operation, the press of a button-like air pump, to effect complete erasure of images/markings. Device 10 also eliminates the necessity of waiting for air to move toward the pump for next drawing action as well as uneliminated, residual air within device 10.

Figure 6:
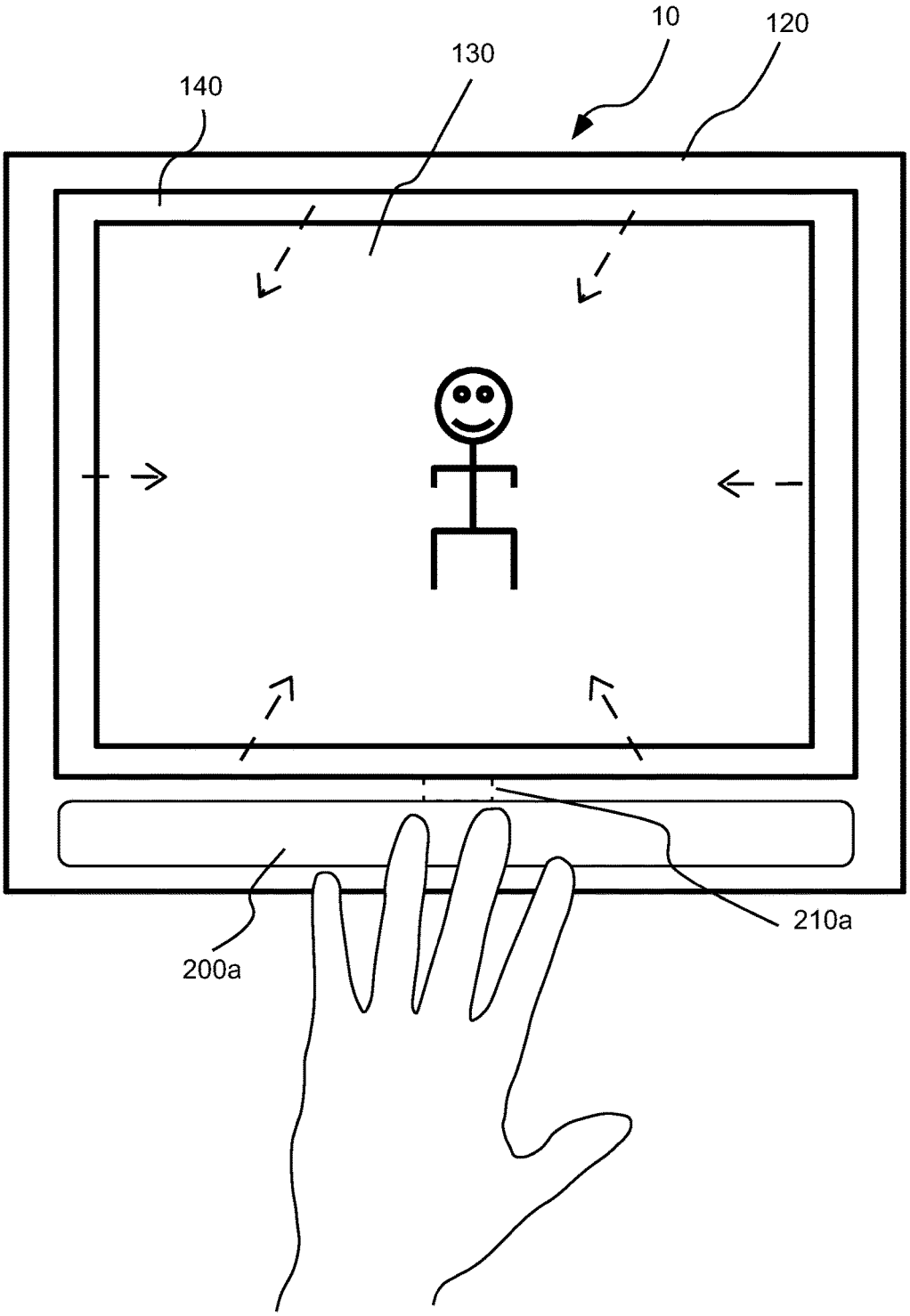
FIG. 6 illustrates a top view of another embodiment of a slate hereof including an integrated pneumatic/air pump, and the process of actuating the pneumatic pump to erase markings.

FIG. 6 illustrated another embodiment of a slate device 10 hereof in which a pump 200*a* is integrated into frame 120. In other respects, slate 10 is formed as described above. In the illustrated embodiment, pump 200*a* includes, for example, an elongated collapsible member in the shape of, for example, a space bar of a keyboard on a lower length of frame 120. Air pump 200*a* may, for example, be connected to frame 120 or formed therein. Air pump 200*a* may, for example, include a collapsible chamber having a volume that is changeable upon application of force by a user. In the illustrated embodiment, pump 200*a* is placed in fluid connection with channel 140 via a connecting conduit or tube 210*a*. In other embodiments, one or more collapsible volumes or chambers of pump 200*a* may be placed in direct fluid connection with channel 140 (that is, without an intervening conduit). In FIG. 6, pump 200*a* has just been actuated and arrows represent the inflow of air from channel 140.

Figure 7:
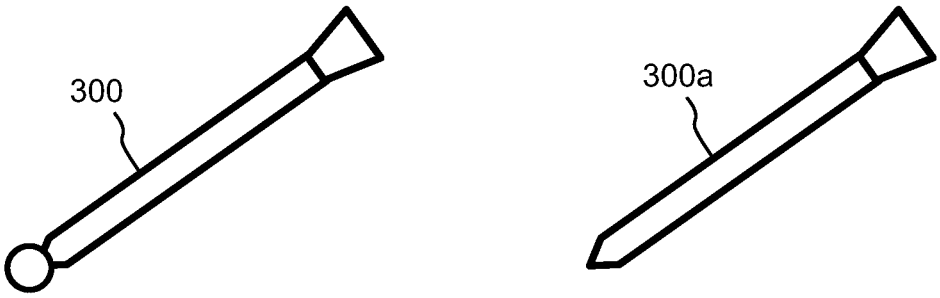
FIG. 7 illustrates two different styluses for use in marking the slates hereof.

FIG. 7 illustrates two different styluses. Stylus 300 has a first end formed with a small ball-like tip to write letters and draw thick lines and a second end formed with a flat head for a sweeping motion to fill in desired areas. Stylus 300*a* has a first end formed with a pointy tip to also write thin letters and also draw thin lines and a second end formed with a flat head for a sweeping motion to fill in desired areas.

The slates hereof may, for example, be used for fun, education, or for situations where verbal communication is not possible because of health or medical issues, noise issues or other situations where verbal communication needs to be replaced with written communication.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. An erasable slate system, comprising: a translucent layer adjacent a colored bottom layer, wherein application of a force to the translucent layer causes temporary adhesion of the translucent layer to the colored bottom layer in an area wherein the force is applied, the erasable slate further comprising an extending channel in fluid connection with the translucent layer and the colored bottom layer, the extending channel extending around at least 25% of the length of a perimeter of the bottom colored layer, and an air pump in fluid connection with the extending channel via which pressurized air can be introduced into the extending channel to cause the translucent layer to be separated from adhesion to the colored bottom layer, thereby erasing markings, and via which air can exit the extending channel.

2. The erasable slate system of claim 1 wherein the air pump is in fluid connection with the extending channel via a port in fluid connection with the extending channel.

3. The erasable slate system of claim 2 wherein the air pump is in fluid connection with the port via a length of tubing.

4. The erasable slate system of claim 3 wherein the extending channel extends around at least 50% of the length of a perimeter of the bottom colored layer.

5. The erasable slate system of claim 3 wherein the extending channel extends around at least 75% of the length of a perimeter of the bottom colored layer.

6. The erasable slate system of claim 3 wherein the extending channel extends around 100% of the length of a perimeter of the bottom colored layer.

7. The erasable slate system of claim 3 wherein the colored bottom layer comprises an adhesive coating so that application of the force to the translucent layer causes temporary adhesion of the translucent layer to the colored bottom layer in an area wherein the force is applied.

8. The erasable slate system of claim 7 wherein the adhesive coating comprises a wax.

9. The erasable slate system of claim 3 wherein the air pump is a bellows pump or a bulb pump.

10. The erasable slate system of claim 3 further comprising a frame and wherein the extending channel is formed in a volume between the frame and the colored bottom layer.

11. The erasable slate system of claim 10 wherein the frame has a thickness in the range of 0.01 to 10 mm.

12. The erasable slate system of claim 3 wherein the extending channel has a width in the range of 0.01 to 30.0 mm.

13. The erasable slate system of claim 3 further comprising a base positioned below the colored bottom layer.

14. The erasable slate system of claim 13 wherein the extending channel is formed in the base.

15. The erasable slate system of claim 1 wherein the extending channel is sealed from fluid connection with an environment outside of the erasable slate system other than via the port.

16. The erasable slate system of any one of claims 1 through 14 further comprising a transparent layer above the translucent layer to which the force is applied.

17. The erasable slate system of claim 10 wherein the tubing has a length suitable to space the pump from the frame and the remainder of the erasable slate system.

18. The erasable slate system of claim 10 wherein the air pump is connected to the frame or formed within the frame.

19. A method of fabricating an erasable slate system, comprising: positioning a translucent layer adjacent a colored bottom layer, wherein application of a force to the translucent layer causes temporary adhesion of the translucent layer to the colored bottom layer in an area wherein the force is applied, providing an extending channel in fluid connection with the translucent layer and the colored bottom layer, the extending channel extending around at least 25% of the length of a perimeter of the bottom colored layer, and providing an air pump in fluid connection with the extending channel via which pressurized air can be introduced into the extending channel to cause the translucent layer to be separated from adhesion to the colored bottom layer, thereby erasing markings, and via which air can exit the extending channel.

* * * * *